US008644750B2

(12) United States Patent
Kagawa

(10) Patent No.: US 8,644,750 B2
(45) Date of Patent: Feb. 4, 2014

(54) FIXING DEVICE INCLUDING RESISTOR LAYERS HAVING VOLUME RESISTIVITY AND IMAGE FORMING APPARATUS HAVING FIXING DEVICE

(75) Inventor: Tetsuya Kagawa, Toyokawa (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 135 days.

(21) Appl. No.: 13/292,515

(22) Filed: Nov. 9, 2011

(65) Prior Publication Data

US 2012/0114401 A1 May 10, 2012

(30) Foreign Application Priority Data

Nov. 9, 2010 (JP) ..... 2010-250704

(51) Int. Cl.
*G03G 15/20* (2006.01)

(52) U.S. Cl.
USPC ..... 399/333; 399/69

(58) Field of Classification Search
USPC ..... 399/330–334
See application file for complete search history.

(56) References Cited

U.S. PATENT DOCUMENTS

| | | | | |
|---|---|---|---|---|
| 6,084,208 | A * | 7/2000 | Okuda et al. | 219/216 |
| 6,285,006 | B1 * | 9/2001 | Hyllberg | 219/216 |
| 2009/0169231 | A1 | 7/2009 | Asakura et al. | |
| 2011/0222932 | A1 * | 9/2011 | Hayase et al. | 399/329 |
| 2011/0299901 | A1 | 12/2011 | Yonekawa et al. | |
| 2011/0299902 | A1 * | 12/2011 | Yonekawa et al. | 399/329 |

FOREIGN PATENT DOCUMENTS

| | | | | |
|---|---|---|---|---|
| JP | 7-244441 | A | | 9/1995 |
| JP | 10-104985 | A | | 4/1998 |
| JP | 10104985 | A | * | 4/1998 |
| JP | 2009-109997 | A | | 5/2009 |
| JP | 2009-157108 | A | | 7/2009 |
| JP | 2011-253085 | A | | 12/2011 |

OTHER PUBLICATIONS

Office Action (Notification of Reasons for Refusal) dated Dec. 11, 2012, issued in corresponding Japanese Patent Application No. 2010-250704, and an English Translation thereof. (5 pages).
Office Action (Notification of Reasons for Refusal) dated Mar. 5, 2013, issued in corresponding Japanese Patent Application No. 2010-250704, and an English Translation thereof. (6 pages).
Decision to Grant a Patent dated Jun. 25, 2013 issued in corresponding Japanese Patent Application No. 2010-250704 and an English Translation thereof (3 pages).

* cited by examiner

*Primary Examiner* — David Gray
*Assistant Examiner* — Tyler Hardman
(74) *Attorney, Agent, or Firm* — Buchanan Ingersoll & Rooney PC

(57) ABSTRACT

A fixing device includes: a rotating fixing body including a resistance heating layer disposed throughout an entire periphery; and a pressure-applying member pressed against an outer peripheral surface of the rotating fixing body to form a fixing nip. The rotating fixing body further includes: a pair of electrodes each of which is a layer disposed along a different one of edges of the resistance heating layer throughout an entire periphery; and a pair of resistor layers each of which is disposed between the resistance heating layer and a different one of the electrodes. An inner edge of each resistor layer is positioned at a location corresponding to or axially more inwardly of an inner edge of the electrode. The resistor layers are higher in volume resistivity than the electrodes.

15 Claims, 8 Drawing Sheets

FIXING DEVICE INCLUDING RESISTOR LAYERS HAVING VOLUME RESISTIVITY AND IMAGE FORMING APPARATUS HAVING FIXING DEVICE

This application is based on application No. 2010-250704 filed in Japan, the contents of which are hereby in incorporate reference.

BACKGROUND OF THE INVENTION (1) Field of the Invention

The present invention relates to a fixing device for thermally fixing an unfixed image formed on a recording sheet and also to an image forming apparatus having the fixing device.

(2) Description of the Related Art

Electrophotographic image forming apparatuses, such as printers and copiers, are typically configured to transfer a tonner image formed according to image data to a recording sheet, such as a sheet of paper or an overhead projector (OHP) sheet, and then fix the tonner image by a fixing device. Fixing of a tonner image by a fixing device involves heating and pressing the tonner image formed on a recording sheet. One heating scheme adopted by a fixing device is a resistance heat generation scheme.

Patent Literature 1 (JP patent application publication No. 2009-109997) discloses a fixing device provided with a heat-generating belt having a resistance heating layer that generates heat upon application of electric current. The fixing device of Patent Literature 1 includes an elastic roll disposed within a running path of the heat-generating belt having a resistance heating layer, so that the heat-generating belt runs in a state sandwiched between the elastic roll and a pressing roller. Between the heat-generating belt and the pressing roller, a fixing nip is formed for a recording sheet to pass through.

Alternating current is applied across the edges of the resistance heating layer included in the heat-generating belt. The edges of resistance heating layer are opposed to each other in the width (axial) direction, which is perpendicular to the running direction of the heat-generating belt. Upon application of alternating current, the resistance heating layer generates Joule heat. Heat evolved in the resistance heating layer is conducted to a recording sheet passing through the fixing nip. As a result, the tonner image on the recording sheet is fixed.

FIG. 8 is a transverse sectional view of a conventional heat-generating belt used in such a fixing device. A heat-generating belt 70 includes a reinforcing layer 71 composed, for example, of polyimide (PI) and also includes a resistance heating layer 72 laminated on the outer peripheral surface of the reinforcing layer 71. An elastic layer 73 and a releasing layer 74 are laminated on the resistance heating layer 72 in the stated order, except along the widthwise (axial) edge portions of the resistance heating layer 72. The resistance heating layer 72 is composed, for example, of a carbon nanomaterial or a polyimide resin in which filamentous metal particles and the like are dispersed.

A pair of electrodes 75 is provided to supply power to the resistance heating layer 72. Each electrode 75 is disposed on the outer peripheral surface of the resistance heating layer 72 throughout the entire periphery along a different one of the edges opposing each other in the axial direction. A pair of power feeders 75 is pressed against the electrodes 75, so that the respective power feeders 76 supply e.g., alternative current to the resistance heating layer 72 via the electrodes 75.

With the above configuration, electric current supplied to one of the edge portions of the resistance heating layer 72 flows through to the other edge portion, so that the resistance heating layer 72 generates heat.

The heat-generating belt 70 having the above configuration has a small heat capacity and thus has excellent temperature rise characteristics. That is, the heat-generating belt 70 quickly reaches high temperatures with a small amount of heat. By virtue of the above characteristics, the power consumption is reduced and the warm-up time is shortened. The fixing device is therefore capable of a fixing operation at high speed.

The heat-generating belt 70 shown in FIG. 8 has the electrodes 75 made of a conductive material with a small volume resistivity, whereas the resistance heating layer 72 has a volume resistivity larger than that of the electrodes 75. Therefore, electric current supplied to one of the electrodes 75 tends to flow to where the volume resistivity is smaller via the shortest path. This result in that electric current in that electrode 75 is localized at a portion around the axially inner edge (i.e., one of the edges of the electrode 75 that is closer to the other electrode 75 and the portion denoted by the letter "A" in FIG. 8).

Similarly, in the other one of the electrodes 75, the electric current from the resistance heating layer 72 locally flows through the upstream edge (a portion denoted by the letter "B" in FIG. 8).

Owing to the excellent temperature rise characteristics of the resistance heating layer 72, the electric current localized at portions of the resistance heating layer 72 on which the axially inner edge of each electrode 75 (i.e., the edge closer to the other electrode 75) is located causes local overheating at the respective portions of the resistance heating layer 72.

FIG. 9 is a graph showing the temperature distribution of the heat-generating belt 70 shown in FIG. 8 at the warm-up under controlled heating to elevate the temperature of the heat-generating belt 70 to 50° C., 100° C., and 150° C. The horizontal axis of the graph corresponds to the width direction (axial direction) of the heat-generating belt 70. In each case, the temperature of the resistance heating layer 72 is higher than the target temperature at each portion on which the axially inner edge of each electrode 75 (i.e., the edge of each electrode 75 closer to the other one of the electrodes 75) is located.

As such, localization of electric current in a specific portion of the resistance heating layer 72 raises the temperature of the portions abnormally high, which may lead to occurrence of smoke. In addition, such high temperatures accelerate deterioration of the portions of the resistance heating layer 72 as compared to the other portions. As a result, the resistance heating layer 72 may not stand a stable long-term use and thus the useful life of the heat-generating belt 70 may be shortened.

SUMMARY OF THE INVENTION

The present invention has been made in view of the problems noted above and aims to provide a fixing device configured to ensure that the heat-generating belt is able to stand stable long-term use, by preventing localization of electric current at specific portions of the electrodes disposed over the resistance heating layer and thus preventing local overheating of the resistance heating layer. In another aspect, the present invention aims to provide an image forming apparatus having such a fixing device.

In order to achieve one of the above aims, the present invention provides a fixing device including: a rotating fixing body including a resistance heating layer disposed throughout an entire periphery, the resistance heating layer generating heat on application of electric current; and a pressure-applying member pressed against an outer peripheral surface of the rotating fixing body to form a fixing nip. The rotating fixing body further includes: a pair of electrodes configured to supply electric current to the resistance heating layer, each electrode being a layer disposed along a different one of edges of the resistance heating layer throughout an entire periphery, the edges opposing each other in an axial direction of the rotating fixing body across the fixing nip; and a pair of resistor layers each disposed between the resistance heating layer and a different one of the electrodes, an inner edge of each resistor layer being at a location corresponding to or axially more inwardly of an inner edge of the electrode, the inner edges being closer to the fixing nip in the axial direction. The resistor layers are higher in volume resistivity than the electrodes.

To achieve the other aim, the present invention provides an image forming apparatus that includes the above-described fixing device.

In another aspect, the present invention provides a fixing device including a rotating fixing body and a pressure-applying member. The rotating fixing body includes: a resistance heating layer disposed throughout an entire periphery, the resistance heating layer generating heat upon application of electric current; and a pair of electrodes each disposed along a different one of axially opposing edges throughout an entire periphery, each electrode configured to supply electric current to the resistance heating layer. The pressure-applying member is pressed against an outer peripheral surface of the fixing body to form a fixing nip. Each electrode covers a corresponding one of edges of the resistance heating layer, the edges opposing each other across the fixing nip in an axial direction of the rotating fixing body. The rotating fixing body further includes a pair of resistor layers each disposed between the resistance heating layer and a corresponding one of the electrodes, the resistor layers being higher in volume resistivity than the electrodes.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes an embodiment of a fixing device and an image forming apparatus according to the present invention.

<Schematic Structure of Image Forming Apparatus>

Figure 1:
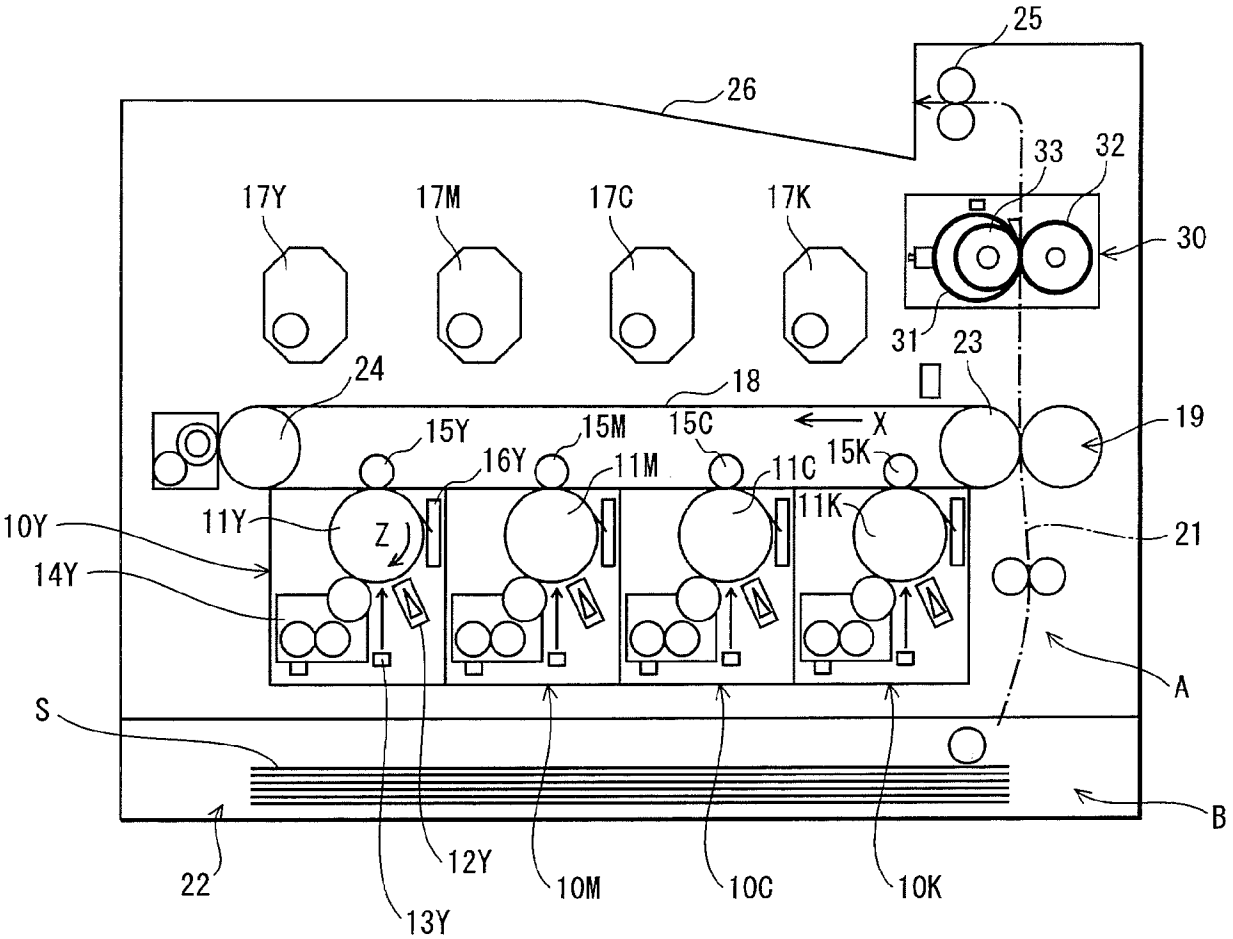
FIG. 1 is a schematic view illustrating the structure of a tandem-type digital color printer, which is one example of an image forming apparatus having a fixing device according to an embodiment of the present invention.

FIG. 1 is a schematic view illustrating the structure of a tandem-type digital color printer (hereinafter, simply "printer"), which is one example of an image forming apparatus having a fixing device according to an embodiment of the present invention. This color printer forms full-color or monochrome images on recording sheets, such as OHP sheets, based on image data input from an eternal terminal or the like via a network (LAN, for example), by a known electrophotography technique.

The printer has an image forming unit A for forming toner images of yellow (Y), magenta (M), cyan (C), and black (K), and also has a sheet feeding unit B located below the image forming unit A. The sheet feeding unit B has a sheet feed cassette 22 that holds recording sheets S therein. The recording sheets S held in the sheet feed cassette 22 is fed one by one to the image forming unit A.

The image forming unit A has an intermediate transfer belt 18 that is horizontally wound around a pair of rollers 23 and 24 to run along an endless path. The intermediate transfer belt 18 is located generally centrally of the printer. Driven by an unillustrated mortar, the intermediate transfer belt 18 runs in a direction shown by the arrow X.

Disposed below the intermediate transfer belt 18 are process units 10Y, 10M, 10C, and 10K. The process units 10Y, 10M, 10C, and 10K are located in the stated order along the running direction of the intermediate transfer belt 18 and each forms a toner image of a corresponding one of the colors of yellow (Y), magenta (M), cyan (C), and black (K) on the intermediate transfer belt 18. The process units 10Y, 10M, 10C, and 10K are removable from the image forming unit A.

Disposed above the intermediate transfer belt 18 are toner containers 17Y, 17M, 17C, and 17K at locations respectively corresponding to the process units 10Y, 10M, 10C, and 10K via the intermediate transfer belt 18. To the process units 10Y, 10M, 10C, and 10K, toners of the respective colors of yellow (Y), magenta (M), cyan (C), and black (K) are supplied from the respective toner containers 17Y, 17M, 17C, and 17K.

The process units 10Y, 10M, 10C, and 10K respectively have photoconductive drums 11Y, 11M, 11C, and 11K each of which is rotatably disposed and located to face the intermediate transfer belt 18 from beneath. The process units 10Y, 10M, 10C, and 10K each form an image on a corresponding photoconductive drum 11Y, 11M, 11C, or 11K using tonner of a corresponding color Y, M, C, or K supplied from a corresponding toner container 17Y, 17M, 17C, or 17K.

Except for the colors of the toner used, the process units 10Y, 10M, 10C, and 10K are all substantially identical in structure. Therefore, the following describes the structure of the process unit 10Y only, and the description of the other process units 10M, 10C, and 10K is omitted.

The photoconductive drum 11Y included in the process unit 10Y is configured to rotate in the direction indicated by the arrow Z. In addition, the process unit 10Y has a charger 12Y disposed below the photoconductive drum 11Y to uniformly charge the surface of the photoconductive drum 11Y. More specifically, the charger 12Y is located to face the photoconductive drum 11Y.

The process unit 10Y also has an exposure unit 13Y and a developer 14Y. The exposure unit 13Y is disposed downstream of the rotational direction of the photoconductive drum 11Y from the charger 12Y and at a location vertically downwardly of the photoconductive drum 11Y. The developer 14Y is disposed downstream of the rotational direction of the photoconductive drum 11Y from the location where the surface of the photoconductive drum 11Y is to be exposed by the exposure unit 13Y.

The exposure unit 13Y emits a laser beam to the surface of the photoconductive drum 11Y having been uniformly charged by the charger 12Y, to form an electrostatic latent image. The developer 14Y develops the electrostatic latent image formed on the surface of the photoconductive drum 11Y, using the Y-color toner.

Disposed above the process unit 10Y is a first-transfer roller 15Y facing the photoconductive drum 11Y via the intermediate transfer belt 18. Note that the first-transfer roller 15Y is attached to the image forming unit A. The first-transfer roller 15Y forms an electric field between the first-transfer roller 15Y and the photoconductive drum 11Y upon application of transfer bias voltage.

Similarly, disposed above the other process units 10M, 10C, and 10K are first-transfer rollers 15M, 15C, and 15K each at a location facing a corresponding one of the photoconductive drums 11M, 11C, and 11K via the intermediate transfer belt 18.

The tonner images formed on the photoconductive drums 11Y, 11M, 11C, and 11K are transferred, in the process of first transfer, to the intermediate transfer belt 18 by the action of the electric field formed between each pair of the first-transfer roller and the photoconductive drum (15Y and 11Y, 15M and 11M, 15C and 11C, and 15K and 11K). After the first transfer process of the toner image, the photoconductive drum 11Y is cleaned by a cleaning member 16Y.

When forming full-color images, the process units 10Y, 10M, 10C, and 10K operate with the timing so adjusted that the respective toner images formed on the photoconductive drums 11Y, 11M, 11C, and 11K are sequentially transferred to be layered at the same location on the intermediate transfer belt 18.

When forming monochrome images, on the other hand, only a selected one of the process units (for example, the process unit 10K for toner of the color K) operates to form a toner image on a corresponding photoconductive drum (the photoconductive drum 11K, in this case). The toner image thus formed is first transferred to a corresponding first-transfer roller (the first-transfer roller 15K, in this case) facing the process unit, and then transferred to the predetermined location on the intermediate transfer belt 18.

The intermediate transfer belt 18 having the tonner image (s) formed thereon runs to carry the tonner image(s) toward the roller 23 (the right-hand roller in FIG. 1) where the intermediate transfer belt 18 turns. A second-transfer roller 19 is disposed to face, across a sheet-transport path 21, the intermediate transfer belt 18 looped around the roller 23. The second-transfer roller 19 is pressed against the intermediate transfer belt 18, whereby a transfer nip is formed therebetween. The second-transfer roller 19 is configured to receive transfer bias voltage. Upon application of transfer bias voltage to the second-transfer roller 19, an electric field is formed between the second-transfer roller 19 and the intermediate transfer belt 18.

A recording sheet S fed into the sheet-transport path 21 from the sheet feed cassette 22 of the sheet feeding unit B is made to pass through the transfer nip formed between the second-transfer roller 19 and the intermediate transfer belt 18. The tonner image transferred to the intermediate transfer belt 18 is then transferred, in the process of second transfer, to the recording sheet S being transported on the sheet-transport path 21. The second transfer is performed by the action of the electric field formed between the second-transfer roller 19 and the intermediate transfer belt 18.

After passing through the transfer nip, the recording sheet S is transported to the fixing device 30 disposed above the second-transfer roller 19. The fixing device 30 applies heat and pressure to fix the unfixed toner image(s) on the recording sheet S. After fixing of the toner image(s), the recording sheet S is ejected by a pair of sheet ejecting rollers 25 to a sheet output tray 26 that is disposed above the toner containers 17Y, 17M, 17C, and 17K.

<Structure of Fixing Device>

Figure 2:
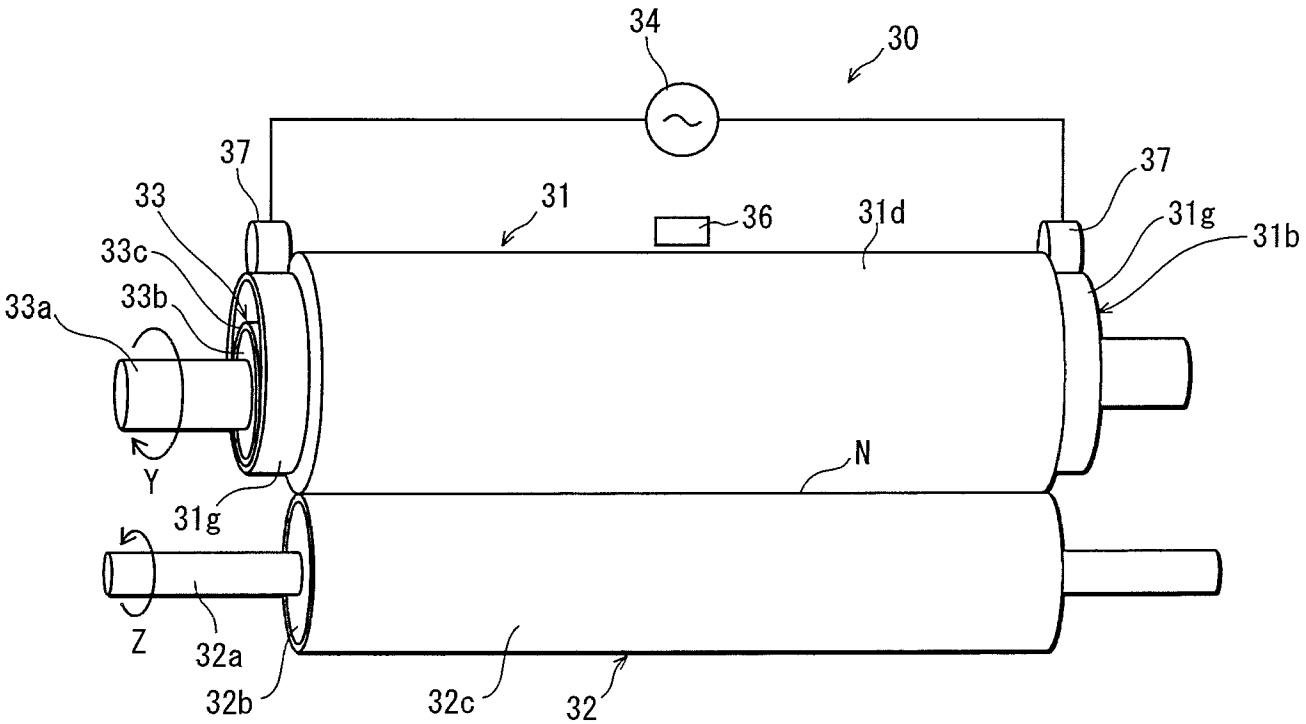
FIG. 2 is an oblique view schematically illustrating the structure of main parts of the fixing device provided in the printer.
Figure 3:
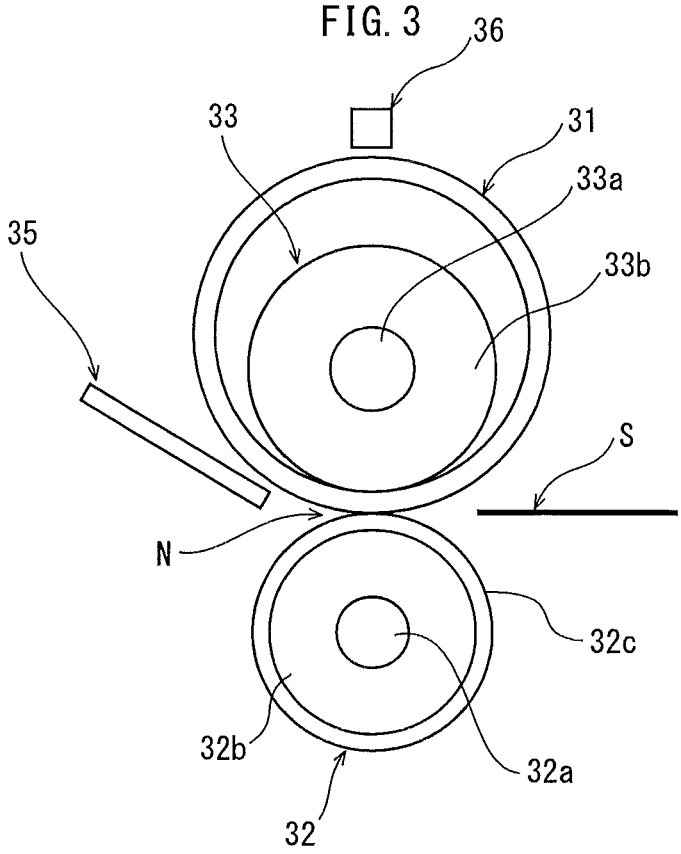
FIG. 3 is a transverse sectional view schematically illustrating the structure of main parts of the fixing device provided in the printer.

FIG. 2 is an oblique view schematically illustrating main parts of the fixing device 30. FIG. 3 is a transverse sectional view schematically illustrating the main parts of the fixing device 30. In FIG. 1, a recording sheet is transported from the bottom to the top of the fixing device 30. However, FIG. 2 illustrates the fixing device 30 in a manner that a recording sheet is transported from a position closer toward the front to a position further away from the front of the figure. Similarly, FIG. 3 illustrates the fixing device 30 in a manner that a recording sheet is transported from the right-hand side to the left-hand side of the figure.

As shown in FIGS. 2 and 3, the fixing device 30 has a pressing roller 32 as a pressure-applying member and also has a heat-generating belt 31 and a fixing roller 33. The heat-generating belt 31 is disposed to rotate (i.e., to travel along an endless path) while being pressed by the pressing roller 32. The fixing roller 33 is disposed inside the rotation path (i.e., the endless pass) of the heat-generating belt 31 to outwardly press the inner peripheral surface of the heat-generating belt 31. The heat-generating belt 31 rotates while being pressed by the pressing roller 32 and includes a resistance heating layer 31*b* (see FIG. 4) that generates heat upon receiving power supply. The heat-generating belt 31 constitutes a rotating fixing body, together with the fixing roller 33 and other components.

The heat-generating belt 31 has, for example, a tubular shape and is slightly longer in an axial length (i.e., the length measured in a direction perpendicular to the rotating direction) than the outer peripheral surface of pressing roller 32 and slightly larger in diameter than the pressing roller 32. The heat-generating belt 31 and the pressing roller 32 are disposed to be axially parallel to each other in a manner that the respective outer peripheral surfaces are pressed against each other. By being pressed against each other, the heat-generating belt 31 and the pressing roller 32 form a fixing nip N for a recording sheet S to pass through.

As illustrated in FIG. 2, the heat-generating belt 31 has a pair of electrodes 31*g* each along a different one of the axially opposing edge portions thereof (i.e., opposing in a direction perpendicular to the rotating direction). The electrodes 31*g* are used to supply electric current to the resistance heating layer 31*b* (see FIG. 4). Each electrode 31*g* is disposed throughout the entire periphery of the heat-generating belt 31 along a different one of the edge portions in manner to continuously cover the inner peripheral surface, the end surface, and the outer peripheral surface of the heat-generating belt 31 (resistance heating layer 31*b*). A pair of power feeders 37 is each pressed against the outer peripheral surface of one of the electrodes 31*g* to make conductive contact.

The power feeders 37 receive alternating current from a commercial AC power source 34 via a harness. Each power feeder 37 is composed, for example, of a conductive brush made by sintering a mixture of carbon powder and copper powder, and the like. The power feeders 37 are made to slide along the respective electrodes 31*g* as the heat-generating belt 31 rotates. With the above configuration, the electrical conductivity between the power feeders 37 and the electrodes 31*g* pressed against each other is maintained.

Note that the power feeders 37 are not limited to conductive brushes and any other component may be usable as a power feeder provided that the electrical conductivity with the electrode 31*g* is maintained by making a sliding contact with the electrode 31*g*. In one alternative, the power feeder 37 may be a conductor, such as metal, or an insulator plated with Cu or Ni, for example. In a yet another alternative, the power feeder 37 may be a rotating body, such as a roller, that rotates while continuously in contact with the electrode 31*g* that also rotates.

A temperature sensor 36 for measuring a temperature of the outer peripheral surface of the heat-generating belt 31 is disposed to face a location centrally of the heat-generating belt 31 in the widthwise direction. The temperature of the heat-generating belt 31 measured by the temperature sensor 36 is used as data for controlling the amount of electric current supplied from the AC power source 34 to the power feeders 37. Note that no description is given of a structure for controlling the amount of electric current supplied from the AC power source 34 to the power feeders 37.

The fixing roller 33 disposed within the running path of the heat-generating belt 31 has an axially disposed core bar and an elastic layer 33*b* laminated on the outer peripheral surface of the core bar 33*a*. Each end of the core bar 33*a* outwardly extends beyond the edge of the elastic layer 33*b*.

The core bar 33*a* is made of a metal cylinder (solid or hollow), such as aluminum or iron, that measures on the order of 10 to 30 mm in diameter. The elastic layer 33*b* is made of an elastic material having an excellent heat resistance. Examples of such elastic materials include silicone rubber and fluorine-containing rubber. The axial length of the elastic layer 33*b* is substantially equal to the axial length of the heat-generating belt 31.

The pressing roller 32 has a core bar 32*a*, an elastic layer 32*b* laminated on the outer peripheral surface of the core bar 32*a*, and a releasing layer 32*c* laminated on the outer peripheral surface of the elastic layer 32*b*. The outer diameter of the pressing roller 32 measures on the order of 20 to 100 mm.

The core bar 32*a* of the pressing roller 32 is axially parallel to the core bar 33*a* of the fixing roller 33 and made of a metal cylinder (solid or hollow), such as aluminum or iron, that measures on the order of 10 to 30 mm in diameter. The elastic layer 32*b* is made of a highly heat-resistant elastic body such as silicone rubber and fluorine-containing rubber and measures on the order of 1 to 20 mm in thickness.

The releasing layer 32*c* is made of a material having a property of helping a recording sheet to come off. Non-limiting examples of such materials include a fluorine-based tube or fluorine-based coating, such as tetrafluoroethylene-perfluoroalkylvinylether copolymer (PFA) resin, polytetrafluoroethylene (PTFE) resin, or ethylene-tetrafluoroethylene (ETFE) resin. The releasing layer 32*c* measures, for example, on the order of 5 to 100 μm in thickness. Note that the releasing layer may be conductive.

The pressing roller 32 is biased toward the heat-generating belt 31 by a non-illustrated biasing means (a tension spring, for example). Due to the bias force, the outer peripheral surface of the pressing roller 32 is pressed against the outer peripheral surface of the heat-generating belt 31, whereby the heat-generating belt 31 is pressed against the fixing roller 33. Where the heat-generating belt 31 makes pressed-contact with the pressing roller 32, a fixing nip N is formed for a recording sheet S to pass through.

The pressing roller 32 is driven by a non-illustrated motor to rotate in the direction indicated by the arrow Z shown in FIG. 2. Being pressed between the pressing roller 32 and the fixing roller 33, the heat-generating belt 31 rotates (travels in an endless path) in the direction indicated by the arrow Y shown in FIG. 2, by following the rotation of the pressing roller 32. Being pressed by the heat-generating belt 31, the fixing roller 33 rotates by following the rotation of the heat-generating belt 31.

Note that the fixing device 30 may be structured to drive the fixing roller 33 to rotate, instead of driving the pressing roller 32 to rotate. Alternatively, the fixing device 30 may be structured to drive both the pressing roller 32 and the fixing roller 33 to rotate.

As illustrated in FIG. 3, a separating pawl 35 is disposed to separate, from the heat-generating belt 31, the recording sheet S having passed through the fixing nip N. The separating pawl 35 is disposed at a location downstream from the fixing nip N in the sheet-transporting direction (at the left-hand side of the figure).

Under the state where the pressing roller 32 and the heat-generating belt 31 are being rotated and where the heat-generating belt 31 is generating heat responsive to the electric current supplied from the AC power source 34, a recording sheet S is transported to pass through the fixing nip N. While passing through the fixing nip N, the recording sheet S is pressurized and heated by the heated heat-generating belt 31, which causes unfixed toner image(s) on the recording sheet S to be fixed. Having passed through the fixing nip N, the recording sheet S is separated from the heat-generating belt 31 by the separating pawl 35 (see FIG. 3).

Figure 4:
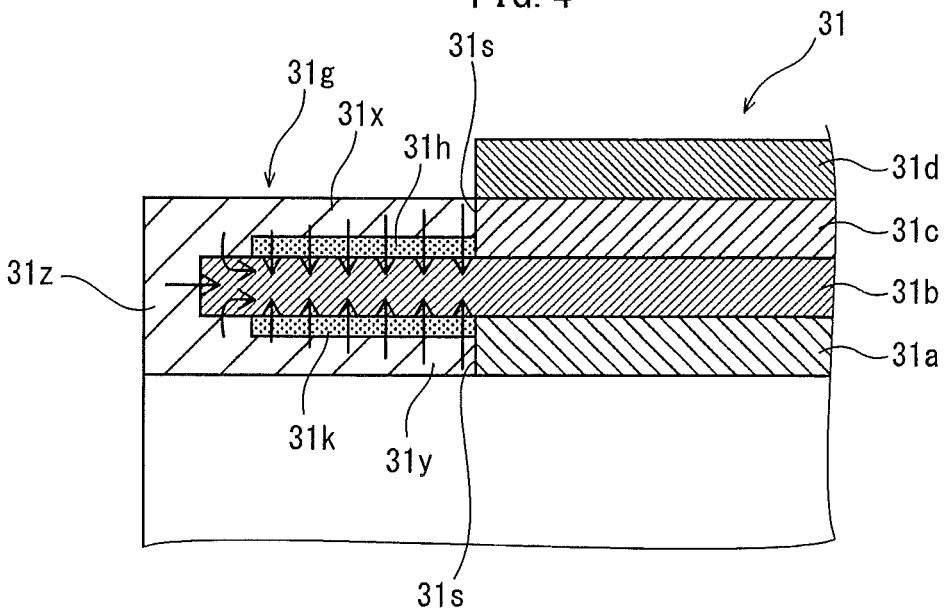
FIG. 4 is a transverse sectional view illustrating one of edge portions of a heat-generating belt provided in the fixing device, the edge portions opposing each other in an axial direction, which is perpendicular to a running direction of the heat-generating belt.

FIG. 4 is a transverse sectional view illustrating one of the axially opposing edge portions of the heat-generating belt 31 (i.e., opposing in a direction perpendicular to the rotating direction of the heat-generating belt 31). The heat-generating belt 31 has a reinforcing layer 31*a* and a resistance heating layer 31*b*. The reinforcing layer 31*a* is made of for example, polyimide (PI) in the shape of a tubular body having a uniform wall thickness. The resistance heating layer 31*b* is disposed on the outer peripheral surface of the reinforcing layer 31*a* throughout the entire periphery. The resistance heating layer 31*b* is made of a material that generates heat through the process of Joule heating upon application of electric current.

The resistance heating layer 31*b* is longer in axial length than the reinforcing layer 31*a*, so that the edge portions of the resistance heating layer 31*b* extend outwardly beyond the edges of the reinforcing layer 31*a*. Each electrode 31*g* is disposed along a different one of the edge portions of the resistance heating layer 31*b* extending beyond the reinforcing layer 31*a*. The electrodes 31*g* are located in flanking relation at the axial edges of the resistance heating layer 31*b* (i.e., axially outwardly from where the fixing nip N is formed).

On the outer peripheral surface of the resistance heating layer 31*b*, an elastic layer 31*c* is disposed so as to be located between the respective electrodes 31*g*. On the outer peripheral surface of the elastic layer 31*c*, a releasing layer 31*d* is disposed.

Each electrode 31*g* is composed of an outer portion 31*x*, an inner portion 31*y*, and a connecting portion 31*z*. The outer portion 31*x* and the inner portion 31*y* respectively cover the outer and inner peripheral surfaces of a corresponding edge portion of the resistance heating layer 31*b*. The connecting portion 31*z* connects the outer portion 31*x* and the inner portion 31*y* at a location axially outwardly of the resistance heating layer 31*b*. The connecting portion 31*z* is in direct contact with the axial end surface of the resistance heating layer 31*b*.

The outer portion 31*x* and the inner portion 31*y* of each electrode 31*g* are equal to each other in axial length, which normally measures on the order of 10 to 15 mm. As shown in FIG. 2, the power feeders 37 are pressed against the respective outer portions 31*x*. The outer portion 31*x*, the inner portion 31*y*, and the connecting portion 31*z* are integrally formed of a material having the volume resistivity that is uniform throughout the electrode 31*g*.

At each axial edge portion of the heat-generating belt 31, an outside film resistor 31*h* is disposed on the outer portion 31*x* so as to cover an annularly continuous surface thereof along an axially inner edge (i.e., the edge located closer to the fixing nip N). That is to say, the outside film resistor 31*h* is disposed between part of the inner peripheral surface of the outer portion 31*x* and part of the outer peripheral surface of the resistance heating layer 31*b*. The outside film resistor 31*h* has a volume resistivity higher than the volume resistivity of the outer portion 31*x* and lower than the volume resistivity of the resistance heating layer 31*b* and serves as a resistor layer for adjusting the electric current density.

Similarly, an inside film resistor 31*k* is disposed on the inner portion 31*y* so as to cover an annularly continuous surface thereof along an axially inner edge (i.e., the edge located closer to the fixing nip N). That is to say, the inside film resistor 31*k* is disposed between part of the outer peripheral surface of the inner portion 31*y* and part of the inner peripheral surface of the resistance heating layer 31*b*. The inside film resistor 31*k* has a volume resistivity higher than the volume resistivity of the inner portion 31*y* and lower than the volume resistivity of the resistance heating layer 31*b* and serves as a resistor layer for adjusting the electric current density.

The outside film resistor 31*h* has a uniform thickness and directly adherent to the outer peripheral surface of the resistance heating layer 31*b* throughout the entire periphery in a manner to leave an axially outer edge portion of the resistance heating layer 31*b* uncovered by the outside film resistor 31*h*. The edge portion left uncovered is of an appropriate width (on the order of 2 to 5 mm from the axial edge of the resistance heating layer 31*b*). Yet, the outside film resistor 31*h* extends fully to the edge 31*s* of the outer portion 31*x* that is closer to the fixing nip N (i.e., to the axially inner end surface of the outer portion 31*x*). The volume resistivity of the outside film resistor 31*h* is entirely uniform.

The outer portion 31*x* covering the outside film resistor 31*h* defines, with the outer peripheral surface, a circumference of a uniform diameter. Similarly, the inner portion 31*y* covering the inside film resistor 31*k* defines, with the inner peripheral surface, a circumference of a uniform diameter. That is, the outside film resistor 31*h* extends between the outer portion 31*x* and the resistance heating layer 31*b*, with the axially inner edge of the outside film resistor 31*h* positioned at a location corresponding to the axially inner end surface 31*s* (i.e., the end surface closer to the fixing nip N) of the outer portion 31*x*. Similarly, the inside film resistor 31*k* extends between the inner portion 31*y* and the resistance heating layer 31*b*, with the axially inner edge of the inside film resistor 31*k* positioned at a location corresponding to the axially inner end surface 31*s* (i.e., the end surface closer to the fixing nip N) of the inner portion 31*y*.

The outside film resistor 31*h* and the outer portion 31*x* are in flush with each other at their respective end surfaces closer to the fixing nip N. That is, at a portion closer to the fixing nip N, the outer portion 31*x* is kept out of contact with the outer peripheral surface of the resistance heating layer 31*b*.

Similarly to the outside film resistor 31*h*, the inside film resistor 31*k* has a uniform thickness and uniform volume resistivity. The inside film resistor 31*k* is directly adherent to the inner peripheral surface of the resistance heating layer 31*b* throughout the entire periphery in a manner to leave an axially outer edge portion of the resistance heating layer 31*b* uncovered by the inside film resistor 31*k*. The edge portion left uncovered should is an appropriate width (on the other of 2 to 5 mm from the axial edge of the resistance heating layer 31*b*). Yet, the inside film resistor 31*k* extends fully to the edge 31*s* of the inner portion 31*y* that is closer to the fixing nip N (i.e., to the axially inner end surface of the inner portion 31*y*). The inside film resistor 31*k* and the inner portion 31*y* are in flush with each other at their respective end surfaces closer to the fixing nip N. The volume resistivity of the inside film resistor 31*k* is entirely uniform. That is, at a portion closer to the fixing nip N, the inner portion 31*y* is kept out of contact with the inner peripheral surface of the resistance heating layer 31*b*.

The resistance heating layer 31*b* is formed by molding a heat-resisting resin in which conductive filler and high-ion conductive powder are uniformly dispersed into a tubular shape. Thus, the electrical resistance of the resistance heating layer 31*b* is ensured to be uniform throughout the entire periphery.

Examples of the heat-resisting resin usable to form the resistance heating layer 31*b* include polyimide (PI), polyphenylenesulfide (PPS), and polyether ether ketone (PEEK). Yet, PI is preferable for its highest heat resistance. In the present embodiment, PI is used for the heating layer 31*b*.

Examples of usable conductive fillers include metal powder having low electrical resistance (high conductivity) and carbon-based powder having high electrical resistance (low conductivity). Preferable examples of usable high-ion conductive powder include silver iodide (AgI) and copper iodide (CuI), each of which is contained in an inorganic compound. Preferable examples of usable metal powder include fine particles of Ag, Cu, Al, Mg, and Ni. Preferable examples of usable carbon compound include graphite, carbon black, carbon nanotube, and carbon nanofiber.

High-ion conductive powder involves no risk of decreasing the mechanical strength of the resistance heating layer 31*b*. However, the use of high-ion conductive powder and highly resistive carbon-based powder alone does not allow the electrical resistance of the resulting resistance heating layer 31*b* to be easily adjusted. The electrical resistance of the resistance heating layer 31*b* needs to be adjusted to cause the fixing device to generate heat of a predetermined heating value when the fixing device operates on 500 to 1500 W of power supplied from a commercial power supply. For this reason, metal power of row resistance is additionally used. With a combined use of metal powder, carbon-based powder, and high-ion conductive powder, the electrical resistance of the resulting resistance heating layer 31*b* is easily adjusted to a predetermine value, without reducing the mechanical strength.

Note that each of the low-resistance metal powder, high-resistance carbon-based powder, and high-ion conductive powder may be composed of two or more different materials.

In addition, it is preferable that each of the low-resistance metal powder, high-resistance carbon-based powder, and high-ion conductive powder be in a filamentary form. Being filamentary, each of the metal powder, carbon-based powder, high-ion conductive powder makes more contact with each other, which helps occurrence of percolation.

Each of the carob-based powder and high-ion conductive powder constituting the high-resistance filler is a material having a negative temperature coefficient (NTC) whose volume resistivity decreases with an increasing temperature. By using a material having NTC, the resulting resistance heating layer 31*b* is ensured to have a negative temperature coefficient (NTC).

Owing to the NTC of the resistance heating layer 31*b*, the risk of overheating is reduced at the areas of the heat-generating belt 31 where a recording sheet S of a smaller size does not pass through (hereinafter, such areas of the heat-generating belt 31 are referred to as "sheet non-passing areas"). That is, when a recording sheet S of a smaller size passes through the fixing nip N and the temperature of the sheet non-passing areas increases to reach a predetermined temperature, the resistivity of the sheet non-passing areas starts to decrease due to the NTC of the resistance heating layer 31*b*. As a result, the heating value of the sheet non-passing areas becomes lower than that of the sheet passing area, so that overheating of the sheet non-passing areas of the heat-generating belt 31 is suppressed.

The use of silver iodide (AgI) or copper iodide (CuI) as the high-ion conductive powder results in the presence of phase transition point, which is a temperature at which the rate of temperature coefficient change undergoes a significant change and thus the resistivity rapidly drops. As a consequence, the effect of preventing overheating of sheet non-passing areas is more notable. In the case of AgI, the phase transition point is normally 147° C. but it depends on the particle size of AgI and is made lower as the particle size is smaller. The same holds with respect to CuI.

Therefore, by suitably selecting particle size of AgI or CuI in view of the fixing temperature, a desired phase transition point is achieved. Especially, in the case where a material of small particle size is used, AgI or CuI is synthesized simply by mixing a silver nitrate ($AgNO_3$) solution, sodium iodide (NaI) solution, and a PVP (Poly-N-vinyl-2-pyrrolidone) solution, which is an silver-ion conductive organic polymer, at atmospheric temperatures and pressures, followed by filtering and drying of the mixture also at atmospheric temperatures and pressures. By changing the concentrations of the solutions and/or mixing procedure, the AgI or CuI is synthesized to have any nanoparticle size ranging from 10 to 50 nm.

Preferably, the particle size of metal powder falls within the range of 0.01 to 10 μm or so. With such a particle size, the high-resistance carbon-based powder and high-ion conductive powder are interlaced together to ensure the entire resistance heating layer 31*b* to have a uniform electrical resistance.

Preferably, the amount of low-resistance metal powder contained in the conductive filler dispersed in the heat-resisting resin falls in the range of 50% to 300% by weight of the heat-resisting resin. Similarly, the amount of high-resistance carbon-based powder and the amount of high-ion conductive powder contained in the conductive filler each preferably fall in the range of 5% to 100% by weight of the heat-resisting resin. If the amount of the metal powder exceeds 300% by weight, there is a risk that the electrical resistance of the resistance heating layer 31*b* becomes too low. On the other hand, if the amount is less than 50% by weight, there is a risk that the electrical resistance of the resistance heating layer 31*b* becomes too high. As described above, neither the amount exceeding 300% by weight nor less than 50% by weight ensures easy adjustment of the volume resistivity to a predetermined value. It is therefore preferable that the metal powder be contained in the amount falling within the range of 50% to 300% by weight of the heat-resisting resin.

Although the resistance heating layer 31*b* may be of any thickness, the thickness on the order of 5 to 100 μm is preferable.

The electrical resistance of the resistance heating layer 31*b* is arbitrarily determined in view of various factors, including the power supplied to the resistance heating layer 31*b*, the voltage applied to the resistance heating layer 31*b*, the thickness of the resistance heating layer 31*b*, and the diameter and axial length of the fixing roller 33. Preferably, however, the electrical resistance of the resistance heating layer 31*b* is on the order of $1.0\times10^{-6}\Omega\cdot m$ to $1.0\times10^{-2}\Omega\cdot m$, and more preferably on the order of $1.0\times10^{-5}\Omega\cdot m$ to $5.0\times10^{-3}\neq\cdot m$.

In order to adjust the volume resistivity of the resistance heating layer 31*b*, conductive particles, such as metal alloy or intermetallic compound, may be appropriately added. Further, to improve the mechanical strength of the resistance heating layer 31*b*, glass fiber, metal whiskers (needle-like single crystals), titanium oxide, potassium titanate, or the like may be added.

Still further, aluminum nitride, alumina, or the like may be added to improve the thermal conductivity of the resistance heating layer 31*b*.

Still further, an imidizing agent, coupling agent, surface-active agent, antifoaming agent, or the like may be added for stable manufacture of the resistance heating layer 31*b*.

For example, the resistance heating layer 31*b* is manufactured by preparing a polyimide varnish by the polymerization of aromatic tetracarboxylic dianhydride with aromatic diamine in an organic solvent and then uniformly dispersing conductive filler in the polyimide varnish. The resulting polyimide varnish is then applied to a mold of a cylindrical shape, followed by imidization.

The elastic layer 31*c* of the heat-generating belt 31 is made of a high-heat resistant elastic body, such as silicone rubber or fluorine-containing rubber. In the present embodiment, silicone (Si) rubber is used as the elastic layer 31*c*.

The releasing layer 31*d* of the heat-generating belt 31 has sheet releasing property imparted by a fluorine-based tube or fluorine-based coating, such as tetrafluoroethylene-perfluoroalkylvinylether copolymer (PFA) resin, polytetrafluoroethylene (PTFE), or ethylene tetrafluoroethylene (ETFE). Preferably, the thickness of the releasing layer 31*d* is on the order of 5 to 100 μm. Preferable examples of fluorine-based tube include "PFA350-J", "451HP-J", and "951HP Plus" all of which are products of Du Pont-Mitsui Fluorochemicals Co., Ltd.

The releasing layer 31*d* has a property of helping a recording sheet S, which is adhered to the layer surface at the time of passing through the fixing nip N, to easily come off.

The releasing layer 31*d* has, for example, water contact angles of 90° or higher, and preferably 110° or higher and also has the surface roughness Ra on the order of 0.01 to 50 μm. Note that the releasing layer 31*d* may be conductive. In the present embodiment, PFA is used as the releasing layer 31*d*.

The reinforcing layer 31*a*, resistance heating layer 31*b*, elastic layer 31*c*, and releasing layer 31*d* each have a predetermined thickness. The heat-generating belt 31 composed of these layers has the rigidity that stays in a tubular shape unless being pressed by the pressing roller 32. The heat-generating belt 31 elastically deforms to conform to the outer peripheral surface of the pressing roller 32, following the elastic deformation of the fixing roller 33 under pressure applied by the pressing roller 32.

Note that the heat-generating belt 31 is not limited to a four-layer structure described above. Alternatively, the heat-generating belt 31 may be of a dual-layer structure composed of the resistance heating layer 31*b* and the releasing layer 31*d*. In addition, in any layer structure, one or more resin layers such as PI or PPS may be additionally provided for insulation. In any layer structure, it is sufficient that the resistance heating layer 31*b* be located radially inwardly as compared with the releasing layer 31*d*.

The conductor constituting each electrode 31*g* may be formed, for example, by applying metal directly to the resistance heating layer 31*b*, by electro or chemical plating. Examples of usable metal include Cu, Al, brass, and phosphor bronze. When the electrodes 31 are formed in this manner, the electro or chemical plating is carried out after the outside and inside film resistors 31*h* and 31*k* are appropriately disposed on the predetermined edge portions of the outer and inner peripheral surfaces of the resistance heating layer 31*b*.

In the case where the electrodes 31*g* are formed by metal plating, it is preferable that two different metals be used. For example, the electrodes 31*g* may be formed first by applying Cu plating to the resistance heating layer 31*b* by chemical plating, and then applying Ni plating to the Cu plating by electro plating.

In addition, the electrodes 31*g* are not limited to those described above. Alternatively, the electrodes 31*g* may be formed by attaching metal foil, such as Cu or Ni, with the use of conductive adhesive between the resistance heating layer 31*b* and the outside film resistor 31*h* as well as between the resistance heating layer 31*b* and the inside film resistor 31*k*.

In another alternative, the electrodes 31*g* may be foamed by applying a conductive ink or paste on the resistance heating layer 31*b*, outside film resistor 31*h*, and inside film resistor 31*k*. In yet another alternative, the electrodes 31*g* may be formed by affixing a conductive tape across the resistance heating layer 31*b*, outside film resistor 31*h*, and inside film resistor 31*k*.

It is sufficient that the volume resistivity of the outside and inside film resistors 31*h* and 31*k* be larger than that of the electrodes 31*g*. Yet, the volume resistivity smaller than that of the resistance heating layer 31*b* is preferable. In one example, the outside and inside film resistors 31*h* and 31*k* may be formed in a manner similar to the resistance heating element 31*b*. That is, the outside and inside film resistors 31*h* and 31*k* may each be formed using a film prepared by dispersing conductive filler in e.g., PI to have an adjusted volume resistivity. Such a film is preferable owing to the easy adjustment of volume resistivity. However, such a film is not the only example and the outside and inside film resistors 31*h* and 31*k* may be formed of metal, such as SUS.

The outside film resistor 31*h* and inside film resistor 31*k* are not limited to any specific thickness. Since the volume resistivity varies depending on the thickness, the outside and inside film resistors 31*h* and 31*k* may be of any thickness that facilitates the adjustment or control of the volume resistivity.

Alternatively to each of the outside and inside film resistors 31*h* and 31*k*, a continuously resistor layer covering both the outer and inner peripheral surfaces of the resistance heating layer 31*b* along each axial edge is usable. Each resistor layer serves as a current density adjustor.

<Operations of Fixing Device>

In the fixing device having the structure described above, when electric current is supplied to one of the power feeders 37, the electric current flows through the resistance heating layer 31*b* from one of the electrodes 31*g* that is in pressed contact with the power feeder 37 to the other electrode 31*g*. Then, the electric current flows into the other power feeders 37 that is in pressed contact with the other electrode 31*g*. The resistance heating layer 31*b* generates heat in response to the passage of electric current.

Note that each electrode 31*g* is continuous from the outer to inner peripheral surfaces of the resistance heating layer 31*b* along a corresponding edge of the resistance heating layer 31*b*. Thus, electric current is distributed to the outer portion 31*x*, connecting portion 31*z*, and inner portion 31*y*, before flowing into the resistance heating layer 31*b* directly or via outside film resistor 31*h* or inside film resistor 31*k*.

As described above, the outside film resistor 31*h* is disposed between the resistance heating layer 31*b* and a part of the outer portion 31*x*, the part being continuous along the edge closer to the fixing nip N. Similarly, the inside film resistor 31*k* is disposed between the resistance heating layer 31*b* and a part of the inner portion 31*y*, the part being continuous along the edge closer to the fixing nip N. It is noted here that the outside and inside film resistors 31*h* and 31*k* are both larger in volume resistivity than the outer and inner portions 31*x* and 31*y* of each electrode 31*g*. Owing to this, the electric current is distributed throughout the outside and inside film resistors 31*h* and 31*k* before flowing into the resistance heating layer 31*b*.

With respect to the path of electric current flow in the outside and inside film resistors 31*h* and 31*k*, the current density within each of the outside and inside film resistors 31*h* and 31*k* tend to increase successively from the axially other edge, which is located away from the fixing nip N, to the axially inner edge, which is located closer to the fixing nip N. Therefore, the density of electric current flowing in the outside film resistor 31*h* or inside film resistor 31*k* toward the resistance heating layer 31*b* is higher at a location closer to the axially inner edge of the respective film (i.e., an edge located closer to the fixing nip N) and successively lower at a location farther from that edge.

Naturally, the density of electric current flowing into the resistance heating layer 31*b* from the outside and inside film resistors 31*h* and 31*k* is higher at a location closer to the axially inner edge of the resistance heating layer 31*b*, (i.e., an edge located closer to the fixing nip N) and successively lower at a location farther from that edge.

As a result, local overheating of the resistance heating layer 31*b* is reliably suppressed and thus the temperature of the resistance heating layer 31*b* is prevented from being excessively high, which eliminates the risk of occurrence of smoke. In addition, local degradation of the resistance heating layer 31*b* is also suppressed, which ensures that the resistance heating layer 31*b* remains usable stably over a long period. Consequently, the longevity of the heat-generating belt 31 is increased.

In addition, the structure of each electrode 31*g* composed of the outer portion 31*x*, connecting portion 31*z*, and inner portion 31*y* also helps to reduce the risk of electric current being localized to a specific portion of the resistance heating layer 31*b*.

Basically the same holds with respect to the other one of the electrodes 31*g*, except for the current flow direction being opposite because the electric current flows from the resistance heating layer 31*b* to the electrode 31*g*.

Regarding the heat-generating belt 31 according to the present embodiment, a sample was prepared by modeling the resistance heating layer 31*b* to perform numerical analysis on the heat distribution. The following describes the numerical analysis. The sample for the numerical analysis was prepared as follows. A resistance heating layer 31*b* measuring 40 μm in thickness and 340 mm in width (axial length) was prepared, and an outside film resistor 31*h* and an inside film resistor 31*k* each measuring 15 μm in thickness and 13 mm in width (axial length) were attached to the resistance heating layer 31*b* along each edge with a 2-mm offset from the edge. More specifically, the outside film resistor 31*h* was attached to the outer peripheral surface, and the inside film resistor 31*k* was attached to the inner peripheral surface. Then, an electrode 31*g* was prepared such that an outer and inner portions 31*x* and 31*y* each measuring 5 μm in thickness was disposed on the outside and inside film resistors 31*h* and 31*k*, respectively.

Figure 5A:
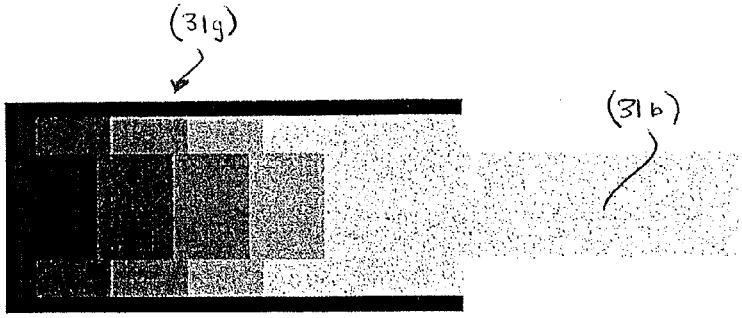
FIGS. 5A and 5B are schematic diagrams each illustrating the result of a numerical analysis of heating distribution measured on samples prepared by modeling a resistance heating layer included in a heat-generating belt, FIG. 5A relating to the present invention, whereas FIG. 5B relating to a comparative example.

The volume resistivity of the resistance heating layer 31*b* was $9.4\times10^{-5}$ Ωm, and the volume resistivity of the electrode 31*g* was $1.72\times10^{-8}$ Ωm. In addition, the volume resistivity of each of the outside and inside film resistors 31*h* and 31*k* was a value falling between the two values ($1.0\times10^{-5}$ Ωm). By applying AC 100 V across the electrodes 31*g*, the temperature distribution illustrated in FIG. 5A was observed. As in the figure, with respect to the edge portion of the resistance heating layer 31*b* along which the electrode 31*g* disposed, the temperature was successively higher at a location farther from the axially outer edge of the resistance heating layer 31*b*. (In FIG. 5A, a lighter color indicates a higher temperature.)

From the above observation, it has been determined that the current density within the outside and inside film resistors 31*h* and 31*k* increased with a distance from the axially outer edge of the resistance heating layer 31*b*.

Figure 6:
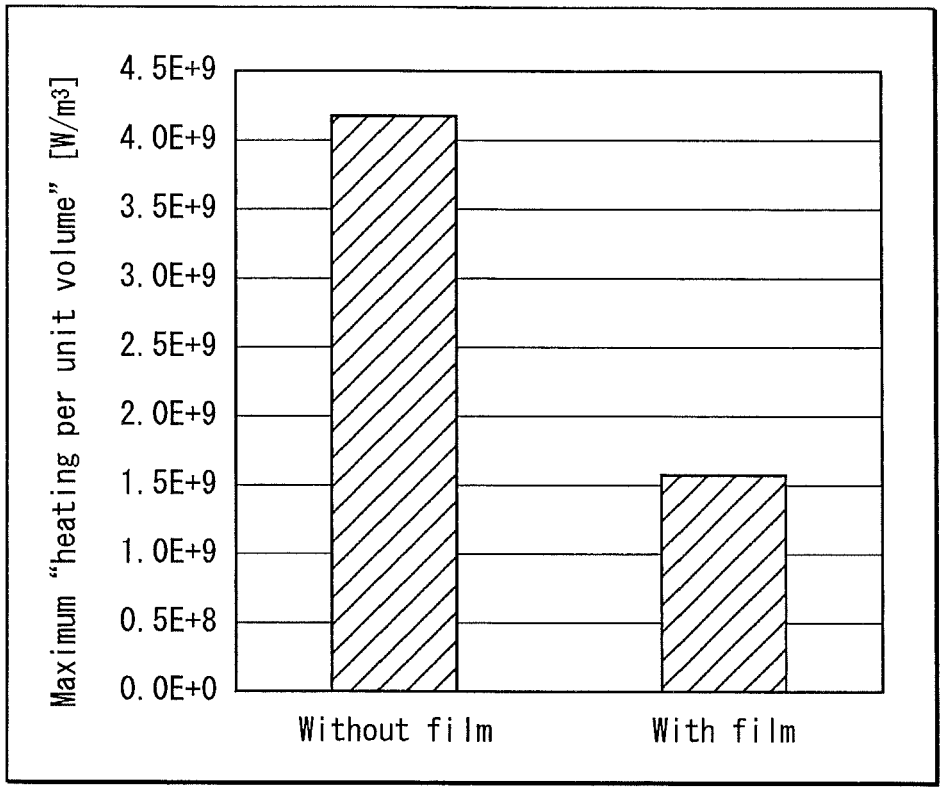
FIG. 6 is a graph showing the maximum heating value per unit area observed in the heating distribution shown in FIGS. 5A and 5B.

The maximum heating value per unit area measured at the axial edge portions of the resistance heating layer 31*b* was $1.56\times10^{9}$ (W/m$^3$), which was measured at a location corresponding to the axially inner edge the electrode 31*g* (i.e., to the edge closer to the fixing nip N). The maximum heating value is shown in the graph of FIG. 6.

Figure 5B:
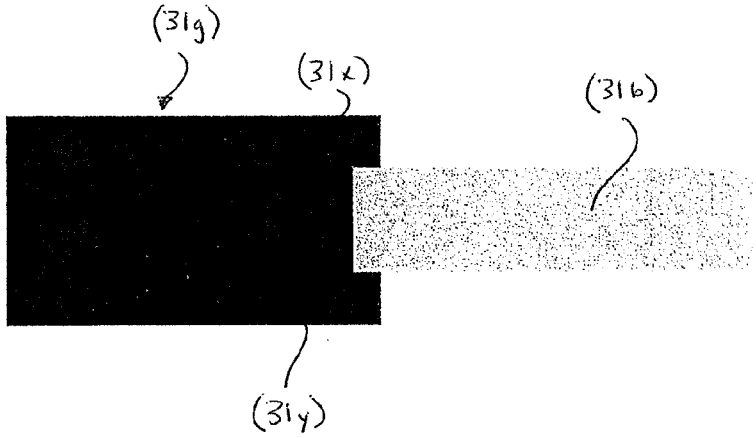

For the purpose of comparison, another sample was prepared which was similar to the above sample except that neither the outside film resistor 31*h* nor inside film resistor 31*k* was provided at the edges of the resistance heating layer 31*b*. Under the same conditions as the above sample, AV voltage was applied to the comparative sample and the temperature distribution illustrated in FIG. 5B was observed. As in the figure, the resistance heating layer 31*b* was elevated to high temperatures locally at portions corresponding to the inner edges of the outer and inner portions 31*x* and 31*y* of the electrode 31*g* (i.e. the edges located closer to the fixing nip N). That is, it is confirmed that the current was localized to such high-temperature portions.

The maximum heating value per unit area measured within the resistance heating layer 31*b* of the comparatives sample was $4.17\times10^{9}$ (W/m$^3$). The maximum heating value is also shown in the graph of FIG. 6.

<Modifications>

Figure 7A:
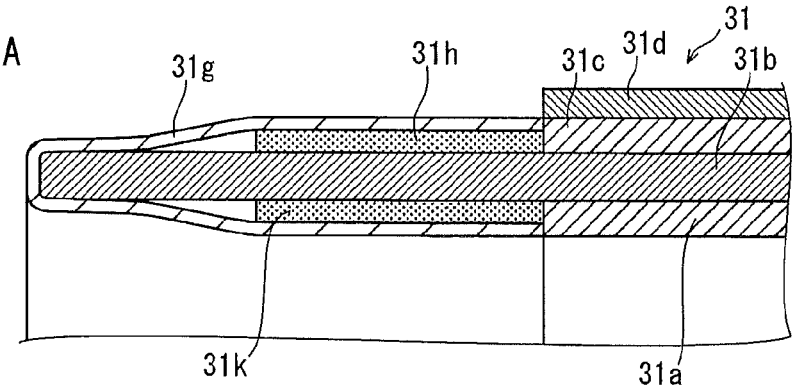
FIGS. 7A, 7B, 7C, and 7D are transverse sectional views each illustrating main parts of a heat-generating belt according to modifications of the present invention.

FIG. 7A is a transverse sectional view of one of the edges of a modified heat-generating belt 31 having an electrode 31*g* formed by a conductive tape. The conductive tape forming the electrode 31*g* is attached to the end surface of the resistance heating layer 31*b* in a manner to continuously cover part of the outer and inner peripheral surfaces of the resistance heating layer 31*b*. In addition, the conductive tape reaches the outer peripheral surface of the outside film resistor 31*h* and the inner peripheral surface of the inside film resistor 31*k*. The conductive tape is bonded to the respective layer and films by a conductive adhesive.

The other structure of the modified heat-generating belt 31 is the same as that illustrated in FIG. 4.

The above modification is also free from a risk of localization of current flowing from the electrode 31*g* to the resistance heating layer 31*b*, so that local overheating of the resistance heating layer 31*b* is suppressed. Consequently, the resistance heating layer 31*b* is prevented from an abnormal temperature rise and also from accelerated deterioration. Consequently, long and stable use of the heat-generating belt 31 is ensured.

Figure 7B:
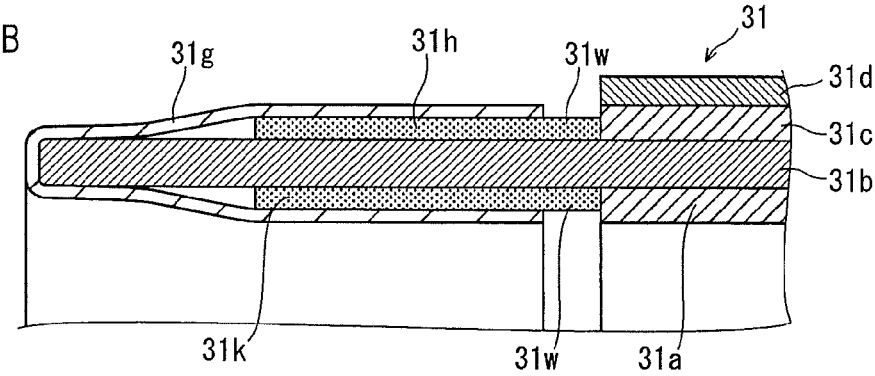

Note in FIG. 7A, the outside and inside film resistors 31*h* and 31*k* are in flush with the electrode 31*g* with respect to their end surfaces located closer to the fixing nip N. However, the structure is not limited to such and may be modified as illustrated in FIG. 7B, for example. In this modification, the outside and inside film resistors 31*h* and 31*k* each have a portion 31*w* extending beyond the electrode 31*g* toward the fixing nip N in the axial direction of the heat-generating belt 31.

With the above configuration, the electric current reaching the axially inner edge (i.e., the edge closer toward the fixing nip N) of each of the outer and inner portions 31*x* and 31*y* of the electrode 31*g* is distributed through the extending portions 31*w* of the outside and inside film resistors 31*h* and 31*k*. As a consequence, the localization of electric current flowing through the resistance heating layer 31*b* is further reduced. Note that the modification shown in FIG. 7B is also applicable to the heating belt 31 illustrated in FIG. 4.

Figure 7C:
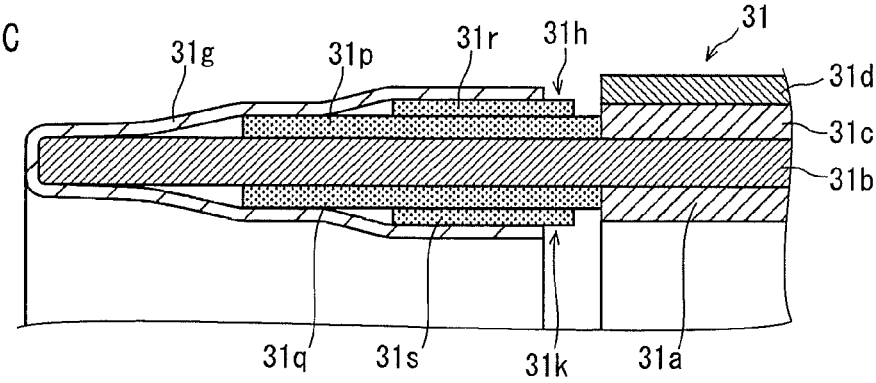

A yet another modification may be made as illustrated in FIG. 7C. That is, the outside film resistor 31*h* may be of a multi-layered structure composed of a first film 31*p* and a second film 31*r*, whereas the inside film resistor 31*k* may be of a multi-layered structure composed of a first film 31*q* and a second film 31*s*. The first films 31*p* and 31*q* are disposed on the outer and inner peripheral surfaces of the resistance heating layer 31*b*, respectively. The second film 31*r* is disposed between the first film 31*p* and a corresponding edge portion of the electrode 31*g*, whereas the second film 31*s* is disposed between the first film 31*q* and a corresponding edge portion of the electrode 31*g*. In this modification, the second films 31*r* and 31*s* extend beyond the edges of the electrode 31*g* toward the fixing nip N in the axial direction of the heat-generating belt 31.

According to this modification, each of the outside and inside film resistors 31*h* and 31*k* is of a multi-layered structure and the number of layers is decreased stepwise from the axially inner edge (i.e. the edge closer to the fixing nip N) of the respective film toward the edge of the resistance heating layer 31*b*. With this structure, the outside and inside film resistors 31*h* and 31*k* each have resistance that is smaller at a location corresponding to the edge of the resistance heating layer 31*b* and larger at a location at the axially inner edge (i.e. the edge closer to the fixing nip N) of the respective film.

Owing to this structure, the current flowing through the outer and inner portions 31*x* and 31*y* increases at a location corresponding to the edge of the resistance heating layer 31*b* and decrease at a location closer to the inner edge thereof (i.e., the edge closer to the fixing nip N). As a result, the amount of current reaching the axially inner edges (i.e., the edges closer to the fixing nip N) of the outer and inner portions 31*x* and 31*y* of the electrode 31*g* is further reduced, so that the electric current flowing in the resistance heating layer 31*b* is prevented from being localized more reliably.

Note that each of the outside and inside film resistors 31*h* and 31*k* may be of a multi-layered structure composed of three of more films.

Note that the modification shown in FIG. 7C is also applicable to the heating belt 31 illustrated in FIG. 4.

Figure 7D:
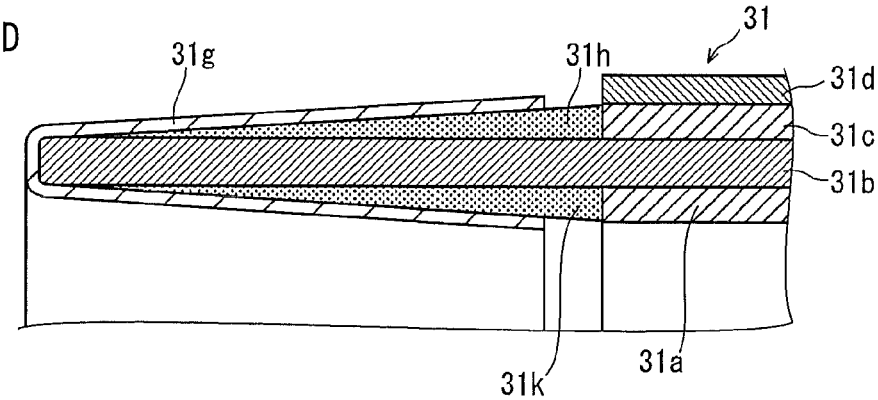
Figure 8:
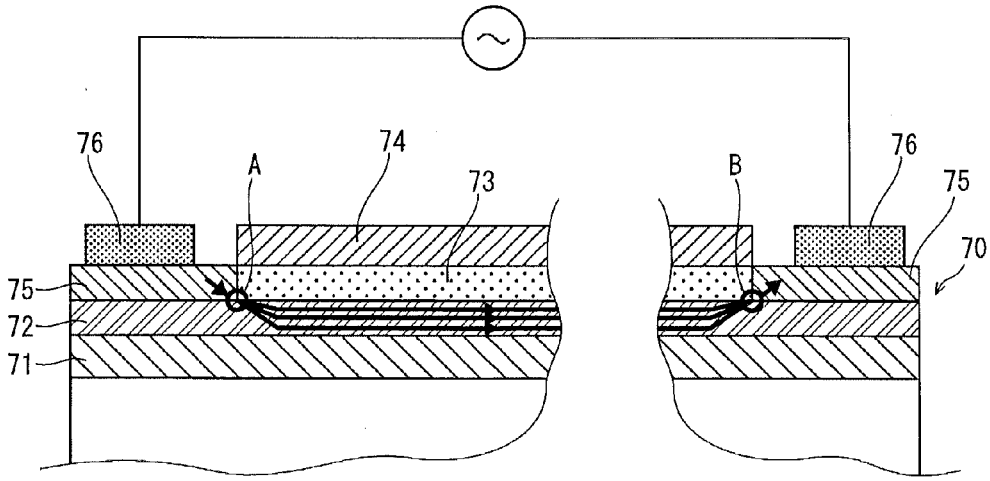
FIG. 8 is a transverse sectional view illustrating a typical structure of a conventional heat-generating belt.
Figure 9:
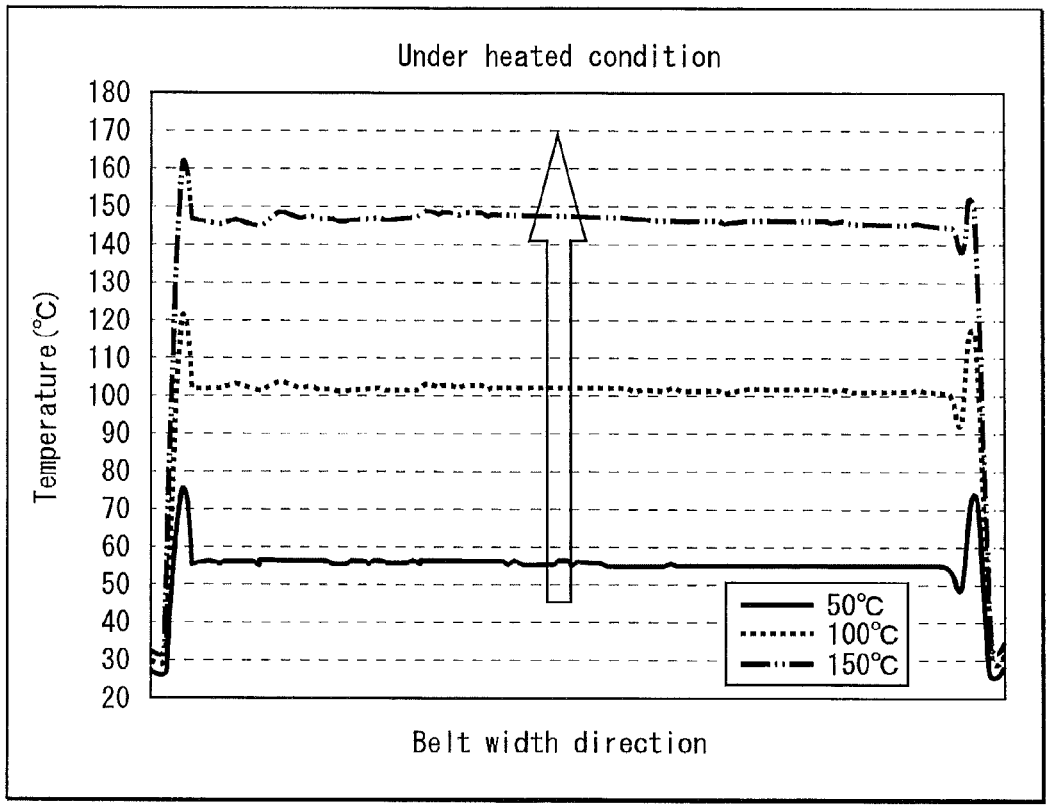
FIG. 9 is a graph showing the temperature distribution of the heat-generating belt shown in FIG. 8 at the warm-up under controlled heating to elevate the temperature of the heat-generating belt to 50° C., 100° C., and 150° C., and the horizontal axis of the graph corresponding to the width direction of the heat-generating belt.

A yet another modification may be made as illustrated in FIG. 7D. That is, the thickness of each of the outside and inside film resistors 31*h* and 31*k* may be configured to be smallest at the axially outer edge thereof (i.e., edge closer to the end surface of the resistance heating layer 31*b*) and continuously smaller toward the axially outer edge thereof (i.e., the edge closer to the fixing nip N). In addition, each of the outside and inside film resistors 31*h* and 31*k* may be disposed so that the smallest thickness edge is located in the vicinity of the end surface of the resistance heating layer 31*b*.

This modification also ensures that the outside and inside film resistors 31*h* and 31*k* each have resistivity that is smallest at a location corresponding to the edge of the resistance heating layer 31*b* and continuously larger toward the axially inner edge (i.e., the edge closer to the fixing nip N). Thus, the current density also increases continuously. With this configuration, the electric current flowing in the resistance heating layer 31*b* is prevented from being localized more reliably. Note that the modification shown in FIG. 7D is also applicable to the heating belt 31 illustrated in FIG. 4.

<Other Modifications>

In the above description, each resistor layer, namely the outside film resistor 31*h* and the inside film resistor 31*k*, has a volume resistivity that is smaller than the volume resistivity of the resistance heating layer 31*b*. However, it is acceptable that the volume resistivity of the outside and inside film resistors 31*h* and 31*k* is larger than the volume resistivity of the resistance heating layer 31*b* to some extent. In this case, too, due to that fact that the resistance heating layer 31*b* is not an insulator, the electric current localized at the axially inner edges (the edge located closer to the fixing nip N) of each electrode 31*g* is distributed by the outside and inside film resistors 31*h* and 31*k*, before flowing into the resistance heating layer 31*b*. Thus, the electric current flowing in the resistance heating layer 31*b* is duly prevented from being localized.

In the above description, in addition, each electrode 31*g* covers the end surface of the resistance heating layer 31*b* as well as part of the outer and inner peripheral surfaces of the resistance heating layer 31*b* throughout the entire periphery thereof. However, the present invention is not limited to such. Each electrode 31*g* may be configured to cover only either the outer or inner peripheral surface of the resistance heating layer 31*b* throughout the entire periphery thereof. In this case, a resistor layer, such as resistor film, is disposed between the electrode 31*g* and whichever peripheral surface covered by the electrode 31*g*.

Further, the heat-generating belt 31 is not necessarily disposed in engagement with the outer peripheral surface of the fixing roller 33. Alternatively, the resistance heating layer 31*b* may be disposed in engagement with the outer the fixing roller 33 and each electrodes 31*g* may be disposed on part of the outer peripheral surface of the resistance heating layer 31*b* exposed at the axial edges.

In addition, in the above description, a commercial AC power source is used as the power supply of the fixing device 30. Alternatively, however, a DC (direct current) poser source may be used.

In addition, in the above description, the pressing roller 32 serving as a pressure applying means is pressed against the heat-generating belt 31 to form a fixing nip N. Alternatively to the pressing roller 32, a pressuring belt may be used as a pressure applying means to form the fixing nip N. In addition, it is not necessary that the pressure applying means rotates. Instead of the pressing roller 32 that rotates, a pressure applying means that is immovably provided may be used.

In addition, the image forming apparatus according to the present invention is not limited to a tandem-type digital color printer and may be a printer for forming monochrome images. Still further, the image forming apparatus according to the present invention is not limited to a printer and may be a copier, MFP (Multiple Function Peripheral), FAX, and the like each for forming color or monochrome images.

<Summary of Embodiments>

A fixing device according to the present invention has a non-insulating resistor layer disposed between the axially inner edge portion (i.e., the edge portion located closer to the fixing nip) of each electrode and the resistance heating layer. Thus, part of the current localized at the inner edges of the electrodes flows into the resistance heating layer via the resistor layers. Here, the volume resistivity of each resistor layer is higher than that of the electrodes and thus the current flowing through the resistor layer is distributed before flowing into the resistance heating layer from the electrode or before flowing into the electrode from the resistance heating layer.

As above, the current localized at the edge of the electrode located in the vicinity of the fixing nip is distributed before flowing into the resistance heating layer. Thus, localization of electric current in the resistance heating layer is prevented, and thus overheating caused by such localization of the current is suppressed, which protects the resistance heating layer from accelerated local degradation. As a consequence, the resistance heating layer is ensured to be stably usable over a long period, and thus the longevity of the heat-generating belt is increased.

Preferably, the resistor layers may be lower in volume resistivity than the resistance heating layer. Preferably, each of the electrodes may be in direct contact with the resistance heating layer at a portion including an outer edge thereof, the outer edge being away from the fixing nip in the axial direction. Preferably, each of the resistor layers may partly located between the resistance heating layer and a corresponding one of the electrodes and may partly extend beyond the inner edge of the electrode toward a location closer to the fixing nip in the axial direction. Preferably, each of the resistor layers may be progressively thicker with increasing distance from a corresponding one of end surfaces of the resistance heating layer, the end surfaces opposing each other in the axial direction. Preferably, each of the resistor layers may be a film disposed on the resistance heating layer. Preferably, each of the electrodes that are opposed across the fixing nip may covers a portion of an inner peripheral surface and a portion of an outer peripheral surface of the resistance heating layer. Each resistor layer may comprises two resistor layers one of which is disposed between the inner peripheral surface of the resistance heating layer and the electrode and another of which is disposed between the outer peripheral surface of the resistance heating layer and the electrode. Preferably, each of the electrodes may be in contact with a corresponding one of end surfaces of the resistance heating layer, the end surfaces opposing each other in the axial direction.

Preferably, the resistor layers may be lower in volume resistivity than the resistance heating layer. Preferably, each of the resistor layers may be progressively thinner toward a corresponding edge of the resistance heating layer. Preferably, each of the electrodes may include: an outer portion covering part of an outer peripheral surface of the resistance heating layer; an inner portion covering part of an inner peripheral surface of the resistance heating layer; and a connecting portion connecting the outer portion and the inner portion at a location outwardly of the resistance heating layer in the axial direction. Preferably, each resistor layer may comprise two resistor layers one of which is disposed between the outer portion of the electrode and the resistance heating layer and another of which is disposed between the inner portion of the electrode and the resistance heating layer. It preferable that none of the resistor layers be disposed between the connecting portion of each of the electrode and the resistance heating layer, whereby the electrode is in direct contact with the resistance heating layer at the connecting portion.

As described above, the present invention is useful for preventing the temperature of a rotating body from raising extremely high, the rotating body being provided for fixing and having a resistance heating layer that generates heats upon application of an electric current.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

What is claimed is:

1. A fixing device comprising:

a rotating fixing body including a resistance heating layer disposed throughout an entire periphery, the resistance heating layer generating heat on application of electric current; and a pressure-applying member pressed against an outer peripheral surface of the rotating fixing body to form a fixing nip, wherein the rotating fixing body further includes:

a pair of electrodes configured to supply electric current to the resistance heating layer, each electrode being a layer disposed along a different one of edges of the resistance heating layer throughout an entire periphery, the edges opposing each other in an axial direction of the rotating fixing body across the fixing nip; and a pair of resistor layers each disposed between the resistance heating layer and a different one of the electrodes, an inner edge of each resistor layer being at a location corresponding to or axially more inwardly of an inner edge of the electrode, the inner edges being closer to the fixing nip in the axial direction, and the resistor layers are higher in volume resistivity than the electrodes.

2. The fixing device according to claim 1, wherein the resistor layers are lower in volume resistivity than the resistance heating layer.

3. The fixing device according to claim 1, wherein each of the electrodes is in direct contact with the resistance heating layer at a portion including an outer edge thereof, the outer edge being away from the fixing nip in the axial direction.

4. The fixing device according to claim 1, wherein each of the resistor layers is partly located between the resistance heating layer and a corresponding one of the electrodes and partly extends beyond the inner edge of the electrode toward a location closer to the fixing nip in the axial direction.

5. The fixing device according to claim 1, wherein each of the resistor layers is progressively thicker with increasing distance from a corresponding one of end surfaces of the resistance heating layer, the end surfaces opposing each other in the axial direction.

6. The fixing device according to claim 1, wherein each of the resistor layers is a film disposed on the resistance heating layer.

7. The fixing device according to claim 1, wherein each of the electrodes that are opposed across the fixing nip covers a portion of an inner peripheral surface and a portion of an outer peripheral surface of the resistance heating layer, and each resistor layer comprises two resistor layers, one of the two resistor layers disposed between the inner peripheral surface of the resistance heating layer and the electrode and another of the two resistor layers disposed between the outer peripheral surface of the resistance heating layer and the electrode.

8. The fixing device according to claim 7, wherein each of the electrodes is in contact with a corresponding one of end surfaces of the resistance heating layer, the end surfaces opposing each other in the axial direction.

9. An image forming apparatus comprising a fixing device, wherein the fixing device includes:

a rotating fixing body including a resistance heating layer disposed throughout an entire periphery, the resistance heating layer generating heat on application of electric current; and a pressure-applying member pressed against an outer peripheral surface of the rotating fixing body to form a fixing nip, the rotating fixing body further includes:

a pair of electrodes configured to supply electric current to the resistance heating layer, each electrode being a layer disposed along a different one of edges of the resistance heating layer throughout an entire periphery, the edges opposing each other in an axial direction of the rotating fixing body across the fixing nip; and a pair of resistor layers each disposed between the resistance heating layer and a different one of the electrodes, an inner edge of each resistor layer being at a location corresponding to or axially more inwardly of an inner edge of the electrode, the inner edges being closer to the fixing nip in the axial direction, and the resistor layers are higher in volume resistivity than the electrodes.

10. A fixing device comprising:

a rotating fixing body including:

a resistance heating layer disposed throughout an entire periphery, the resistance heating layer generating heat upon application of electric current; and a pair of electrodes each disposed along a different one of axially opposing edges throughout an entire periphery, each electrode configured to supply electric current to the resistance heating layer; and a pressure-applying member pressed against an outer peripheral surface of the fixing body to form a fixing nip, wherein each electrode covers a corresponding one of edges of the resistance heating layer, the edges opposing each other across the fixing nip in an axial direction of the rotating fixing body, and the rotating fixing body further includes a pair of resistor layers each disposed between the resistance heating layer and a corresponding one of the electrodes, the resistor layers being higher in volume resistivity than the electrodes.

11. The fixing device according to claim 10, wherein the resistor layers are lower in volume resistivity than the resistance heating layer.

12. The fixing device according to claim 11, wherein each of the resistor layers is progressively thinner toward a corresponding edge of the resistance heating layer.

13. The fixing device according to claim 12, wherein each of the electrodes includes:

an outer portion covering part of an outer peripheral surface of the resistance heating layer;

an inner portion covering part of an inner peripheral surface of the resistance heating layer; and a connecting portion connecting the outer portion and the inner portion at a location outwardly of the resistance heating layer in the axial direction.

14. The fixing device according to claim 13, wherein each resistor layer comprises two resistor layers, one of the two resistor layers disposed between the outer portion of the electrode and the resistance heating layer and another of the two resistor layers disposed between the inner portion of the electrode and the resistance heating layer.

15. The fixing device according to claim 14, wherein the resistor layers are not disposed between the connecting portion of each of the electrode and the resistance heating layer, whereby the electrode is in direct contact with the resistance heating layer at the connecting portion.

* * * * *